US007441290B1

(12) United States Patent
Flick

(10) Patent No.: US 7,441,290 B1
(45) Date of Patent: Oct. 28, 2008

(54) MATTRESS HINGES TO PROVIDE GREATER STABILITY AND LOWER SHEAR

(75) Inventor: Roland E. Flick, Elma, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 0 days.

(21) Appl. No.: 11/973,174

(22) Filed: Oct. 5, 2007

(51) Int. Cl.
*A61G 7/057* (2006.01)
*A47C 27/10* (2006.01)

(52) U.S. Cl. ..... 5/615; 5/715; 5/713; 5/722; 5/727; 5/732

(58) Field of Classification Search ..... 5/615, 5/607–610, 715, 710, 713, 660, 691, 694, 5/722, 727, 732, 425
See application file for complete search history.

(56) References Cited

U.S. PATENT DOCUMENTS

| | | | | | |
|---|---|---|---|---|---|
| 4,916,765 | A * | 4/1990 | Castronovo, Jr. | ..... | 5/640 |
| 4,934,002 | A * | 6/1990 | Watanabe | ..... | 5/607 |
| 4,947,500 | A * | 8/1990 | Seiler | ..... | 5/713 |
| 4,977,629 | A * | 12/1990 | Jones | ..... | 5/632 |
| 5,394,577 | A * | 3/1995 | James et al. | ..... | 5/713 |
| 5,533,218 | A * | 7/1996 | Fahy | ..... | 5/636 |
| 5,682,633 | A * | 11/1997 | Davis | ..... | 5/636 |
| 5,794,289 | A | 8/1998 | Wortman et al. | | |
| 5,926,879 | A * | 7/1999 | Davis | ..... | 5/636 |
| 5,926,883 | A | 7/1999 | Rechin et al. | | |
| 5,956,787 | A * | 9/1999 | James et al. | ..... | 5/713 |
| 6,061,855 | A * | 5/2000 | Flick | ..... | 5/713 |
| 6,079,070 | A * | 6/2000 | Flick | ..... | 5/715 |
| 6,085,372 | A * | 7/2000 | James et al. | ..... | 5/713 |
| 6,145,142 | A * | 11/2000 | Rechin et al. | ..... | 5/706 |
| 6,154,900 | A * | 12/2000 | Shaw | ..... | 5/81.1 R |
| 6,739,001 | B2 * | 5/2004 | Flick et al. | ..... | 5/425 |
| 6,823,546 | B1 * | 11/2004 | Hsu | ..... | 5/636 |
| 7,007,330 | B2 * | 3/2006 | Kuiper et al. | ..... | 5/715 |
| 7,013,512 | B1 * | 3/2006 | Hsu | ..... | 5/636 |
| 7,246,388 | B2 | 7/2007 | DiLiberto, Jr. | | |
| 7,260,860 | B2 | 8/2007 | Chambers et al. | | |
| 2002/0133877 | A1 * | 9/2002 | Kuiper et al. | ..... | 5/81.1 R |
| 2007/0143928 | A1 * | 6/2007 | Biggie et al. | ..... | 5/715 |

* cited by examiner

*Primary Examiner*—Robert G Santos
(74) *Attorney, Agent, or Firm*—Roach Brown McCarthy & Gruber, P.C.; Kevin D. McCarthy

(57) ABSTRACT

A rotational mattress has (a) a support surface and a rotating bladder object or (b) the support surface, the rotating bladder and a cushion material object. Depending on the embodiment used, the rotating bladder object and/or cushion material object has at least one longitudinal hinge; a longitudinal hinge extends from the object's head end toward the object's foot end. In one embodiment, the longitudinal hinge can be a shaped aperture and within the shaped aperture is a second cushion material. The second cushion material is less rigid than the cushion material.

20 Claims, 11 Drawing Sheets

MATTRESS HINGES TO PROVIDE GREATER STABILITY AND LOWER SHEAR

FIELD OF THE INVENTION

The present invention is directed to a mattress having hinges or living hinges.

BACKGROUND OF THE INVENTION

Slit Horizontal Hinges

In U.S. Pat. No. 7,260,860; Chambers et al. described a mattress assembly having a head end, a foot end, a right side, and a left side. The mattress has a horizontal slit hinge positioned from the right side to the left side of a foam mattress. That horizontal slit hinge assists the mattress assembly alter its position in a gatch bed. A gatch bed is a bed with divided sections for independent elevation (up and down) of a patient's head and knees.

That understanding of Chambers et al.'s hinge is confirmed in the following extract from the '860 patent: "The foam layers . . . of the core portion . . . include a laterally extending slit . . . defining a hinge to assist in bending of the mattress assembly . . . during articulation of the support deck . . . . Similarly, each width adjustment bladder . . . includes a slit . . . positioned [vertically] adjacent the slit . . . to define a hinge point. A tube . . . may be positioned within each bladder . . . at the hinge point to prevent the air flow path from being sealed when the mattress assembly . . . is bent."

Accordingly horizontal slit hinges in foam mattresses that extend from the right side to the left side are known to those of ordinary skill in the art. Moreover, other than air nothing is positioned within the horizontal slit hinges.

Pivot Horizontal Hinges

In U.S. Pat. No. 7,246,388; DiLiberto, Jr. discloses an alternative to Chamber et al.'s horizontal slit foam mattress. Instead of using horizontal slits, DiLiberto, Jr. uses a "hinge assembly [comprising] a nylon tubing . . . , two washers . . . , a threaded T-nut . . . and a bolt . . . . That hinge assembly is positioned from the right side to the left side of the mattress. Like Chambers et al., DiLiberto, Jr.'s hinge assembly mattress is effective for a gatch bed. DiLiberto, Jr.'s hinge assembly is impractical for a rotating mattress because the tubing extends across the width of the mattress (right side to left side) and inhibits a mattress' rotating ability.

Rotating Mattress

Rotating a patient on an inflatable mattress is also well known to those of ordinary skill in the art. Rotating a patient is one method to avoid and/or decrease the formation of bed sores on immobile patients. A rotatable inflatable mattress and the method in which the mattress rotates the patient are disclosed in U.S. Pat. Nos. 5,794,289 and 5,926,883 which are commonly assigned and are hereby incorporated by reference.

In those patents, Gaymar Industries, Inc. illustrated FIGS. 1 and 2. In FIGS. 1 and 2, there is illustrated generally at 170 a mattress containing an inflatable cushion 180 which is tiltable to one side, as illustrated in FIGS. 3 and 4, for the purpose of rolling a patient, illustrated at 171, over, placing the patient in a better position for lifting from the mattress, or otherwise moving the patient as needed.

In a preferred embodiment, the mattress 170 includes a foam support member 172 on which rests a tilting assembly, illustrated generally at 174, which will be described hereinafter, the tilting assembly 174 disposed generally within and circumscribed about its periphery by a lower crib 176. The crib 176 in turn supports an upper crib 178, in which is contained the cushion 180. The cushion 180 may be any suitable cushion material including inflatable air bladders having button welds, illustrated at 186, uniformly spaced thereover to prevent ballooning thereof when pressurized.

The tilting assembly 174 comprises two sets of bladders, each set of bladders includes an upper and a lower inflatable bladder 182 and 184 respectively the width of each of which being slightly less than half of the width of cushion 180. The bladders 182, 184 are further divided into right bladders 182*a*, 184*a* and left bladders 182*b*, 184*b*. The foot end portions 188 of the lower bladders 184 are tapered over about one-third of the length thereof to allow relatively greater lifting capacity for the head end and central portions supporting the torso of a patient since the torso requires greater lifting capacity than the feet. The upper bladder 182 may be any suitable inflatable bladders and have button welds, illustrated at 186, uniformly spaced thereover to prevent ballooning thereof when pressurized. As seen in FIG. 1, each lower bladder 184 is absent button welds or the like so that it may desirably balloon when pressurized to lift the corresponding side of the cushion 180 as needed. Otherwise, bladders 182, 184 include inflation means, such as pumps and the like.

A fabric strip 190 can bridge across and is adhesively or otherwise suitably attached to the upper surface of crib 178 for lateral stability. The cribs 176 and 178 and support member 172 are adhesively or otherwise suitably attached, and the assembly including the tilting assembly 174 and cushion 180 are enclosed within a zippered mattress cover 175 as shown in FIG. 2.

FIG. 2 illustrates the mattress 170 with the cushion 180 in a level condition for the patient 171 to lie normally thereon. In this condition, the cushion 180 and upper bladder 182 are fully inflated while the lower bladder 184 is uninflated.

FIG. 3 illustrates tilting of the cushion 180 to about a 15 degree angle to one side by deflating the left side bladder 182*b* and by inflating the right side bladder 184*a*. As seen in FIG. 3, this first inflation/deflation protocol lowers the left side of the cushion 180 and raises the right side thereof thereby providing a "trough," illustrated at 192, on the left side to prevent the patient 171 from falling off the mattress. The patient 171 is thus "caught" by the upper crib 178 with the fabric strip 190 providing lateral stability to prevent the crib 178 from bowing outwardly.

FIG. 4 illustrates tilting of the cushion 180 from the position of FIG. 2 to about a 15 degree angle to the other side by deflating the right side upper bladder 182*a* and by inflating the left side lower bladder 184*b*. This second inflation/deflation protocol lowers the right side of the cushion 180 and raises the left side thereof thereby providing a "trough" 192 on the right side to prevent the patient from falling off the mattress. The fabric strip 190 again provides lateral stability to prevent the crib from bowing outwardly.

The cushion 180 may of course be tilted to a higher angle than 15 degrees. For example, the cushion 180 may be tilted to an angle of perhaps about 45 degrees by further inflation of the corresponding lower bladder 184, allowing ballooning thereof so that it approaches a tubular shape, and the width of the fabric strip 190 is selected to suitably accommodate the degree of tilt.

Conventional Rotating Mattress' Fulcrum Point

As identified above, rotating mattresses are some times made with a crib. The crib is designed to inhibit a patient from falling off the mattress by having the patient caught within the trough between the cushion material and the crib. There is at least one problem with catching the patient in a trough.

That problem is the patient can get too close to the crib while in the trough which can cause adverse effects. An example of an adverse effect includes and is not limited to a patient being trapped between the cushion and the crib and/or the crib increasing the tissue interface pressure to the patient's skin. That event can occur because a rotating mattress' fulcrum 700 is at the cushion's edge closest to the trough. The mattress' fulcrum at the cushion's edge is undesirable because it promotes a patient to (a) fall off the mattress when a crib is not used and/or (b) be positioned against the crib when a crib is used which can increase the patient's tissue interface pressure. The present invention is designed to solve that problem(s).

SUMMARY OF THE INVENTION

A rotational mattress has (a) a support surface and a rotating bladder object or (b) the support surface, the rotating bladder and a cushion material object. Depending on the embodiment used, the rotating bladder object and/or cushion material object has at least one longitudinal hinge; a longitudinal hinge extends from the object's head end toward the object's foot end. In one embodiment, the longitudinal hinge can be a shaped aperture and within the shaped aperture is a second cushion material. The second cushion material is less rigid than the cushion material.

DETAILED DESCRIPTION OF THE INVENTION

Figure 5:
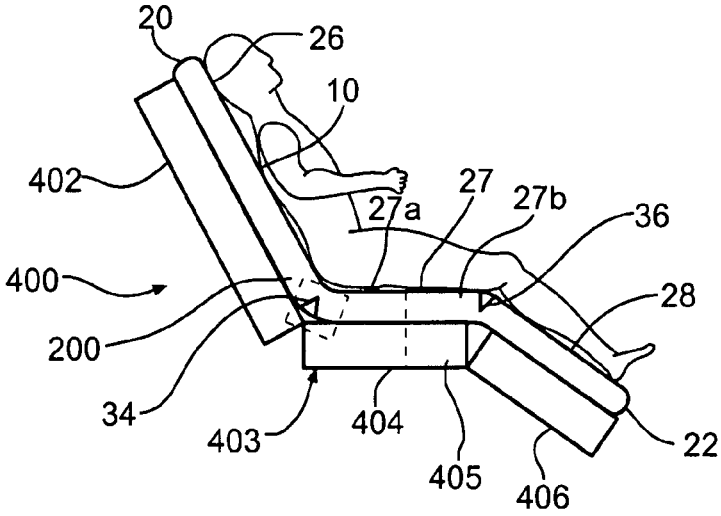
FIG. 5 is a side view of a mattress positioned on a gatching bed support surface.

The present invention is directed to a rotatable mattress 10. The rotatable mattress 10 can be positioned on a gatching support surface 400 as illustrated in FIG. 5, a flat support surface 500 as illustrated in FIG. 6, or a contoured surface 600 as illustrated in FIG. 7.

The gatching support surface 400 is divided into sections. Those sections include an upper body section 402, a seat section 403 (which can also be subdivided into a buttock section 404 and a thigh section 405 in some embodiments), and a knee support section 406, as illustrated at FIG. 5. The gatching support surface 400 and its respective sections 402, 403 (404 and 405), and 406 are well known to those of ordinary skill in the art. An example of how a gatching support surface operates is disclosed in U.S. Pat. No. 5,423,097, which is hereby incorporated by reference. Generically, a gatching support surface has movable upper body and knee support sections, and first and second coupling arrangements which each couple a respective drive arrangement to one of the upper body and knee support sections to effect movement thereof between inclined and horizontal positions.

Figure 6:
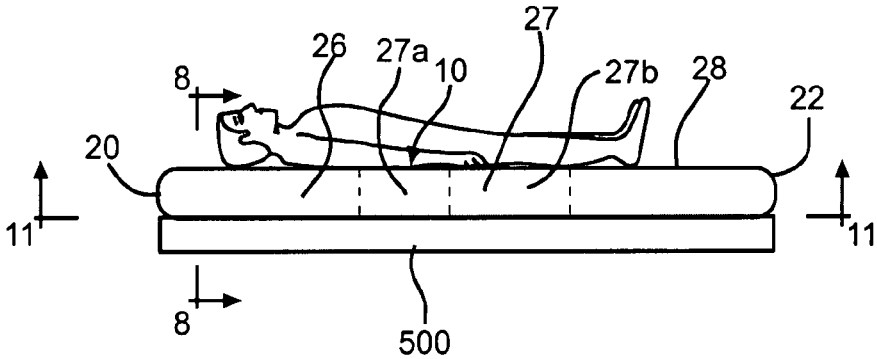
FIG. 6 is a side view of a mattress positioned on a flat support surface.

The flat support surface 500 is exactly that, a flat support surface as illustrated at FIG. 6. The flat support surface 500 has the upper body section 402, the seat section 403 (which can be subdivided into the buttock section 404, the thigh section 405), and the thigh section 406 even though the flat support surface does not adjust like a gatching support surface.

Figure 7:
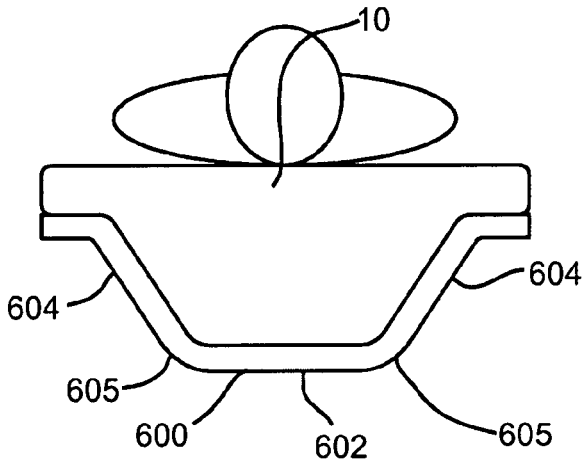
FIG. 7 is a side view of a mattress positioned on a contoured mattress surface.

The contoured support surface 600 has a base section 602 and sides 604 protruding from at least the right perimeter 605 and left side perimeter 606 of the base section 602 as illustrated at FIG. 7. The contoured support surface 600 can even be a variation of the gatching support surface and has the upper body section 402, the seat section 403 (which can be subdivided into the buttock section 404, the thigh section 405), and the thigh section 406.

FIRST EMBODIMENT

Figure 8:
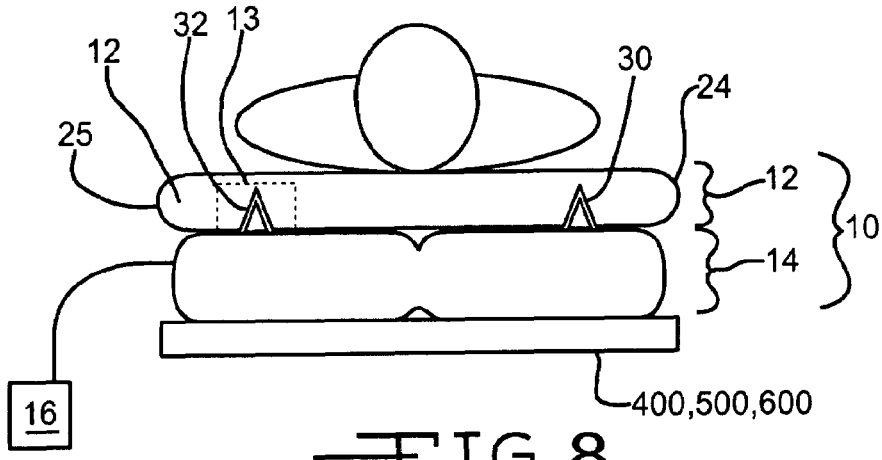
FIG. 8 is cross-sectional view of FIG. 6 taken along the lines 8-8.

In a first embodiment, the rotatable mattress 10 has a cushion material 12 and a rotating bladder 14. The cushion material 12, as illustrated in FIG. 8, is positioned over the rotating bladder 14 and the support surface 400, 500, 600. And the rotating bladder 14 (and possibly the cushion material 12) is interconnected to a pump system 16 that provides a fluid to at least the rotating bladder 14 (and depending on the type of cushion material 12 used, to the cushion material 12).

Cushion Material 12

The cushion material 12 can be any suitable cushion material including and not limited to (a) an inflatable bladder or a plurality of inflatable bladders (air, water, or combinations thereof) having or not having button welds uniformly spaced thereover to prevent ballooning thereof when pressurized; (b) a gelastic cushion or a plurality of gelastic cushions made of tri-block copolymeric compositions, an example and not limited to such is described in U.S. Pat. No. 7,060,213; (c) a foam cushion or a plurality of foam cushions, or (d) combinations thereof.

Figure 11:
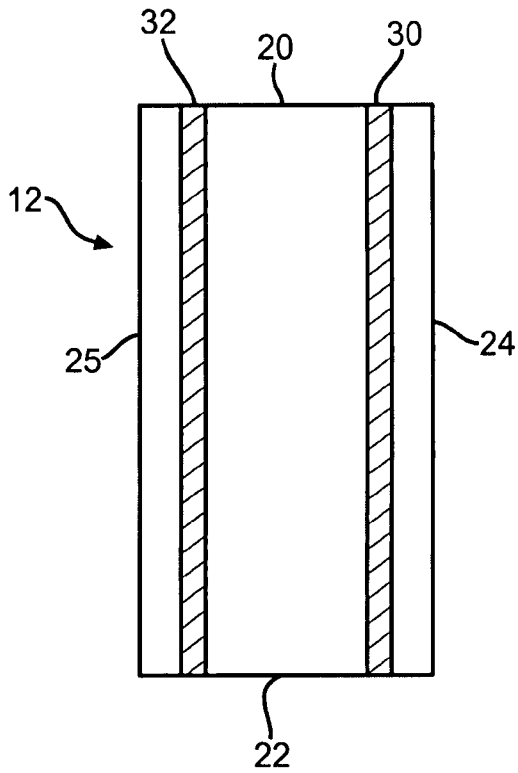
FIG. 11 is a view of FIG. 6 taken along the lines 11-11.

The cushion material 12 has a head end 20, a foot end 22 (as seen in FIGS. 5, 6 and 11), a right side edge 24 and a left side edge 25 (as seen in FIGS. 8 and 11). The cushion material 12 can be further identified in sections. Those sections include a head/torso section 26 that normally receives a patient's head and torso, a seat section 27 that normally receives a patient's thigh and buttocks (which can also be subdivided into a thigh section 27*b* and a buttock section 27*a*), and a lower leg section 28 that normally receives a patient's calves and feet.

Longitudinal Hinges

In the embodiments illustrated in FIGS. 8, 9, 10, 17, and 18, the cushion material 12 has a first longitudinal hinge 30 and a second longitudinal hinge 32.

Figure 10:
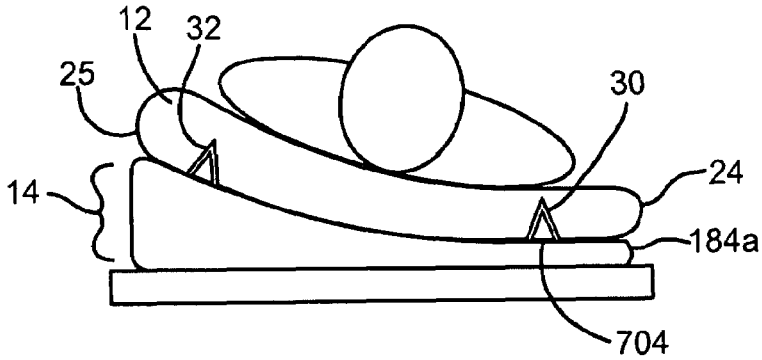
FIG. 10 is FIG. 8 rotating toward the patient's right side.

The first longitudinal hinge 30 (a) is positioned parallel to and near the right side edge 24 to inhibit the right side edge 24 from becoming the fulcrum point when the cushion material's left side is raised as illustrated in FIG. 10, and (b) extends from the head end 20 to a first predetermined point toward the foot end 22. Preferably, the first longitudinal hinge 30 is positioned between 5 to 30 centimeters, preferably 10 to 20 centimeters, from the right side edge.

Figure 12:
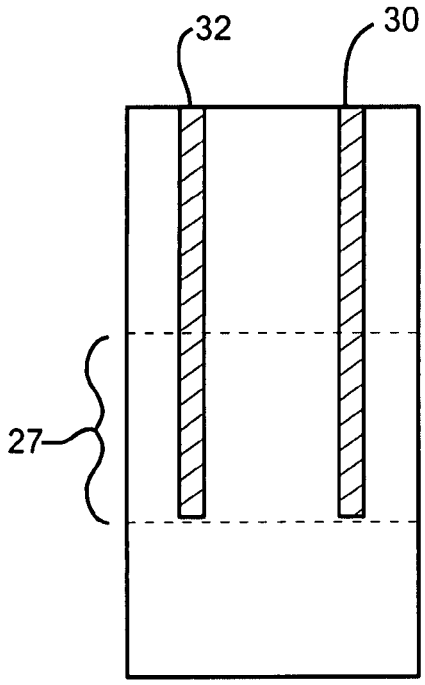
FIG. 12 is an alternative embodiment of FIG. 11.
Figure 16A:
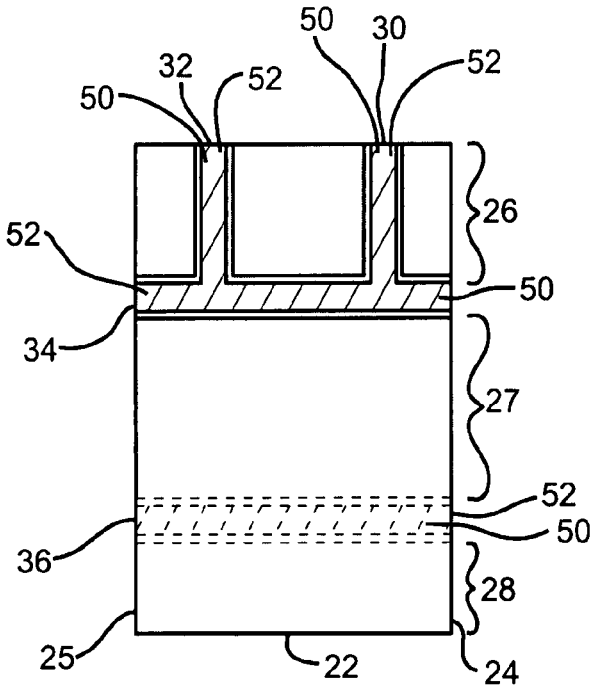
FIG. 16*a* is a second alternative embodiment of FIG. 11.
Figure 16B:
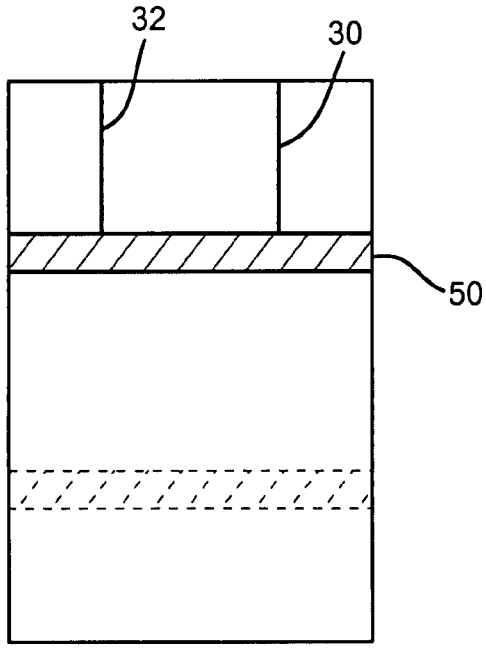
FIG. 16*b* is an alternative embodiment of FIG. 16*a*.

The first predetermined point toward the foot end 22 can be the foot end 22 (as shown in FIG. 11), in the lower leg section 28, at the juncture between the lower leg section 28 and the seat section 27, in the seat section 27 (as shown in FIG. 12), at the juncture between the seat section 27 and the head/torso section 26 (as shown in FIG. 16), or in the head/torso section 26 and a predetermined distance away from the head end to inhibit the right side edge from becoming the fulcrum point when the cushion material's left side is raised.

The second longitudinal hinge 32 (a) is positioned parallel to and near the left side edge 25 to inhibit the left side edge 25 from becoming the fulcrum point when the cushion material's right side is raised, and (b) extends from the head end 20 to a second predetermined point toward the foot end 22. Preferably, the second longitudinal hinge 32 is positioned between 5 to 30 centimeters, preferably 10 to 20 centimeters, from the left side edge.

The second predetermined point toward the foot end 22 can be the foot end 22, in the lower leg section 28, at the juncture between the lower leg section 28 and the seat section 27, in the seat section 27, at the juncture between the seat section 27 and the head/torso section 26, or in the head/torso section 26 and a predetermined distance away from the head end to inhibit the left side edge from becoming the fulcrum point when the cushion material's right side is raised.

The first predetermined point and the second predetermined point can be equivalent points on opposite sides of the cushion material 12, or different points. Preferably, the first predetermined point and the second predetermined point are at equivalent points on opposite sides of the cushion material 12.

Horizontal Hinges

If the cushion material 12 is positioned over the gatching support surface 400 or variations thereof, then the cushion material 12 has the first longitudinal hinge 30 (described above), the second longitudinal hinge 32 (described above), a first horizontal hinge 34 positioned at the juncture between the seat section 27 and the head/torso section 26, and a second horizontal hinge 36 positioned at the juncture between the lower leg section 28 and the seat section 27.

The first horizontal hinge 34 (as seen at FIG. 16) corresponds with the juncture between the upper body section 402 and the buttocks section 404; while the second horizontal hinge 36 corresponds with the juncture between the buttocks section 404 and the knee support section 406. That means the first horizontal hinge 34 and the second horizontal hinge 36 extend from the right side edge 24 to the left side edge 25.

Hinge Embodiments

The first horizontal hinge 34 and the second horizontal hinge 36 are not just slits in the cushion material 12. Nor do the first horizontal hinge 34 and the second horizontal hinge 36 have rods and pins. Instead the first horizontal hinge 34 and the second horizontal hinge 36 and in a preferred embodiment the first and second longitudinal hinges 30, 32 are designed to decrease the shear forces applied to the patient when the cushion material 12 moves in a rotational method and/or a gatching method and/or move the fulcrum point toward the hinge area and not at the mattress' side.

Figure 13:
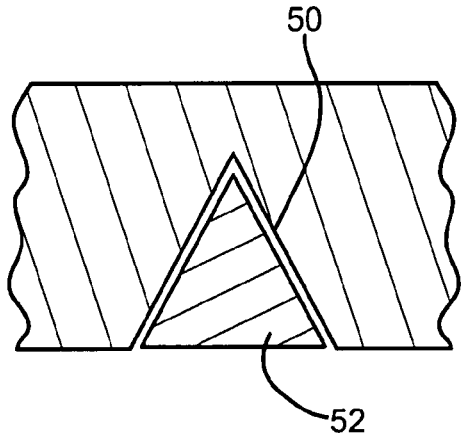
FIG. 13 is an enlarged view of FIG. 8 taken from box 13.
Figure 14:
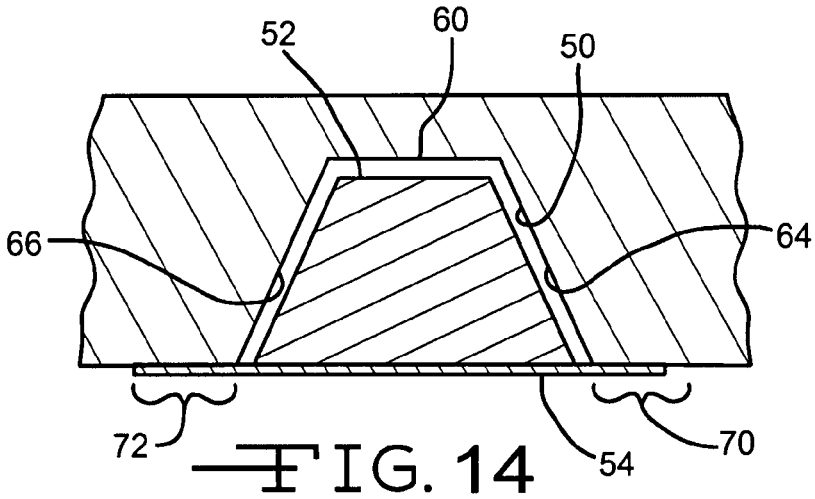
FIG. 14 is an alternative embodiment of FIG. 13.
Figure 15:
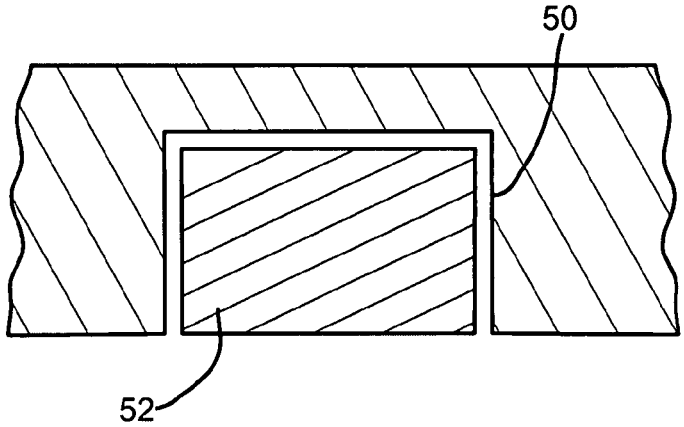
FIG. 15 is a second alternative embodiment of FIG. 13.

To accomplish these objectives for the first horizontal hinge 34 and the second horizontal hinge 36 and in the preferred embodiment for the first and second longitudinal hinges 30, 32, each hinge has a shaped opening 50 in the cushion material 12. The shaped opening 50 has a measurable length, a measurable width and a measurable height (which does not include a mere slit). Examples of the shaped opening include and are not limited to a triangular shape (FIG. 13), a trapezoidal shape (FIG. 14), and a squared (or rectangular) shape (FIG. 15). Each shaped opening 50 has a top area 60 (which can also be a bottom area if the cushion material 12 has the shaped opening 50 facing the patient as illustrated in FIG. 5 item 36), a first side 64, and a second side 66. The cushioned material 12 that is positioned adjacent to (a) the first side 64 is referred to as the first attachment area 70 and (b) the second side 66 is referred to as the second attachment area 72.

Within the shaped opening 50 is a second cushion material 52. The second cushion material 52 is less rigid than the cushion material 12. Examples of the second cushion material include and are not limited to foam materials, gelastic materials, air bladders with low air loss apertures and equivalents thereof. Obviously, the second cushion material may be the same generic material as the cushion material except the second cushion material is less rigid than the cushion material 12.

The second cushion material 52 remains within the shaped opening 50 through adhesives and/or a bridge material 54 (an example includes and is not limited to a non-woven material) that is attached to the first attachment area 70 and the second attachment area 72. The bridge material 54 may also be attached to the second cushion material 52 that is in the same plane as the first attachment area 70 and the second attachment area 72 when the cushion material 12 is in a single plane.

Figure 20A:
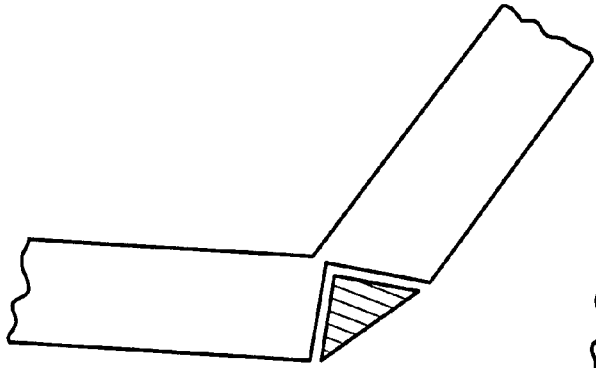
FIG. 20*a* is an enlarged view of FIG. 5 taken from the box 200 without a patient positioned thereon.
Figure 20B:
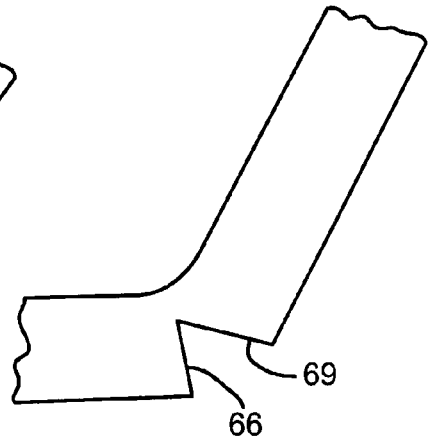
FIG. 20b (Prior Art)
FIG. 20*b* is the prior art version of a slit horizontal hinge without a patient positioned thereon.
Figure 21A:
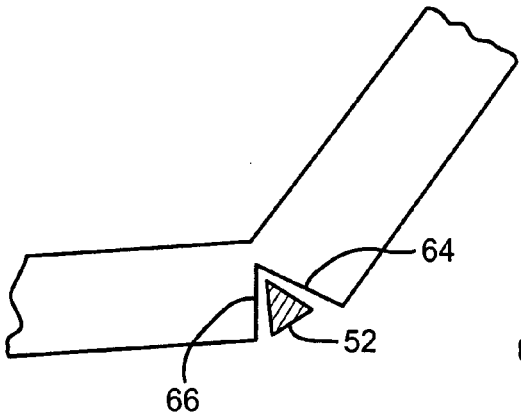
FIG. 21*a* is FIG. 20*a* with pressure thereon.
Figure 21B:
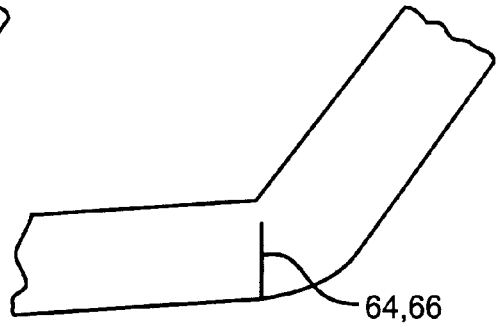
FIG. 21b (Prior Art)
FIG. 21*b* is FIG. 20*b* with pressure thereon.

The decrease in shear force is illustrated by comparing no pressure applied to the cushions—FIG. 20*a* (the present invention) and FIG. 20*b* (the prior art)—to when pressure is applied to the cushions—FIG. 21*a* (the present invention) and FIG. 21*b* (the prior art). As clearly illustrated, when no pressure is applied the difference between FIG. 20*a* and FIG. 20*b* are insignificant. The differences become pronounced when pressure (shown as an arrow) is applied. Notice that in FIG. 21*a*, the first side 64 does not effectively contact the second side 66 due to the second cushion material 52 positioned between the sides 64, 66. Admittedly, second cushion material 52 becomes compressed but it does not completely compress so the first side 64 and the second side 66 completely contact each other as illustrated in FIG. 21*b*. When the first side 64 and the second side 66 contact each other, the cushion material 12 inherently slides. That sliding motion increases the shear applied to the patient, which is undesirable.

Rotating Bladder

The rotating bladder 14 can be the tilting assembly 174 of the prior art which is described in the section entitled "background of the invention" and incorporated by reference herein. As previously stated, the tilting assembly 174 can comprise two sets of bladders; each set of bladders includes an upper inflatable bladder 182 and a lower inflatable bladder 184. The bladders 182, 184 are further-divided into right bladders 182*a*, 184*a* and left bladders 182*b*, 184*b*. The foot end portions 188 of the lower bladders 184 are tapered over about one-third of the length thereof to allow relatively greater lifting capacity for the head end and central portions supporting the torso of a patient since the torso requires greater lifting capacity than the feet. The upper bladder 182 may be any suitable inflatable bladders and have button welds, illustrated at 186, uniformly spaced thereover to prevent ballooning thereof when pressurized. Each lower bladder 184 is absent button welds or the like so that it may desirably balloon when pressurized to lift the corresponding side of the cushion 180 as needed. Otherwise, bladders 182, 184 include inflation means, such as pumps and the like.

Fabric Strip

A fabric strip 190 can bridge across and is adhesively or otherwise suitably attached to the upper surface of crib 178 for lateral stability. The cribs 176 and 178 and support member 172 are adhesively or otherwise suitably attached, and the assembly including the tilting assembly 174 and cushion 12 are enclosed within a zippered mattress cover 175 as shown in FIG. 17.

Rotational Movement

Figure 17:
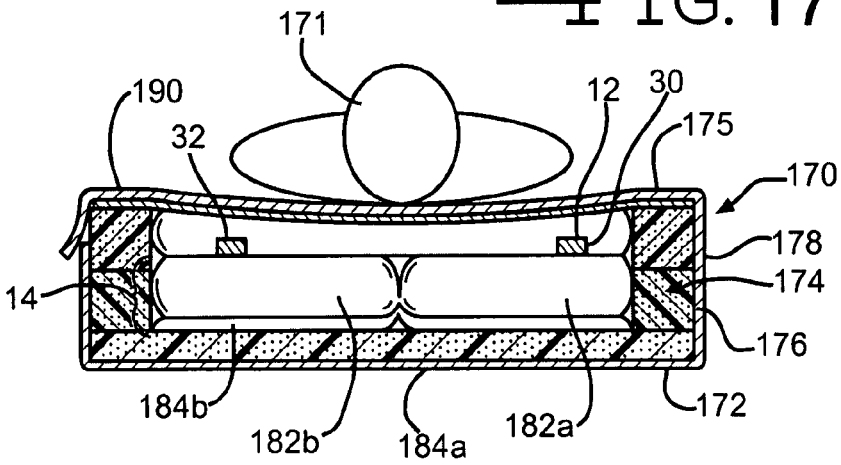
FIG. 17 is an alternative embodiment of FIG. 8.

FIG. 17 illustrates the mattress 10 with the cushion 12 in a level condition for the patient 171 to lie normally thereon. In this condition, the cushion 180 and upper bladder 182 are fully inflated while the lower bladder 184 is uninflated.

Figure 18:
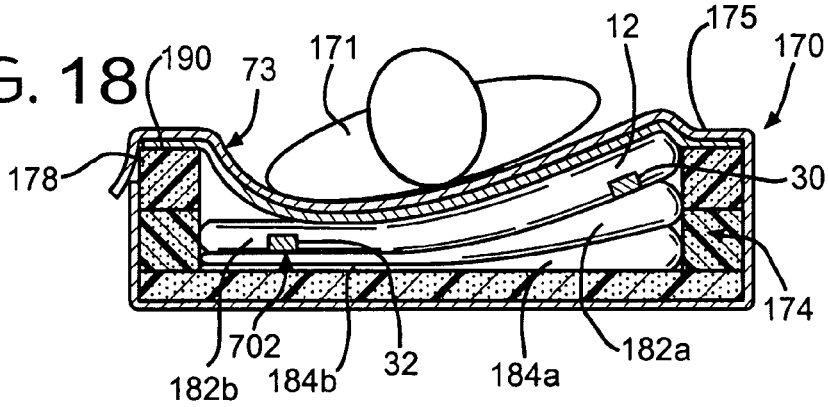
FIG. 18 is FIG. 17 rotating toward the patient's left side.

FIG. 18 illustrates tilting of the cushion 180 to about a 15 degree angle to one side by deflating the left side bladder 182*b* and by inflating the right side bladder 184*a*. As seen in FIG. 18, this lowers the left side of the cushion 180 and raises the right side thereof thereby providing a "lower trough," illustrated at 73.

The lower trough 73 is immaterial to the present invention because the second longitudinal hinge 32 becomes the cushion's 12 left fulcrum point 702. By moving the cushion's 12 left fulcrum point away from left edge (as used in the prior art), the lower trough is not necessary to inhibit the patient 171 from falling off the mattress. The patient 171 is thus inhibited from being "caught" by the upper crib 178 with the fabric strip 190 providing lateral stability to prevent the crib 178 from bowing outwardly. Instead, the patient does not have to contact the crib but remain securely positioned on the cushion 12 without any increase in tissue interface pressure caused by the crib and/or the lower trough.

Figure 19:
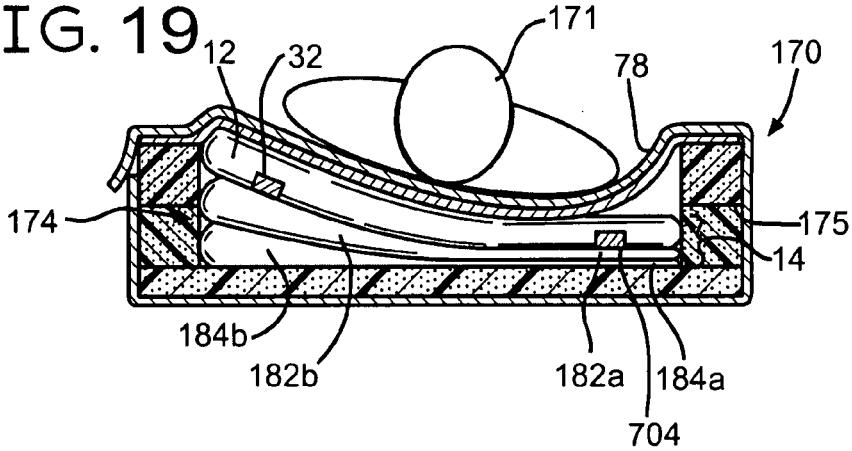
FIG. 19 is FIG. 17 rotating toward the patient's right side.

FIG. 19 illustrates tilting of the cushion 12 from the position of FIG. 18 to about a 15 degree angle to the other side by deflating the right side upper bladder 182*a* and by inflating the left side lower bladder 184*b*. This lowers the right side of the cushion 180 and raises the left side thereof thereby providing a "lower trough" 78.

The lower trough 78 is immaterial to the present invention because the first longitudinal hinge 30 becomes the cushion's 12 right fulcrum point 704. By moving the cushion's 12 right fulcrum point away from right edge (as used in the prior art), the lower trough is not necessary to inhibit the patient 171 from falling off the mattress. The patient 171 is thus inhibited from being "caught" by the upper crib 178 with the fabric strip 190 providing lateral stability to prevent the crib 178 from bowing outwardly. Instead, the patient does not have to contact the crib but remains securely positioned on the cushion 12 without any increase in tissue interface pressure caused by the crib and/or the lower trough.

The cushion 12 may of course be tilted to a higher angle than 15 degrees. For example, the cushion 12 may be tilted to an angle of perhaps about 45 degrees by further inflation of the corresponding lower bladder 184, allowing ballooning thereof so that it approaches a tubular shape, and the width of the fabric strip 190 is selected to suitably accommodate the degree of tilt.

ALTERNATIVE EMBODIMENT

Figure 9:
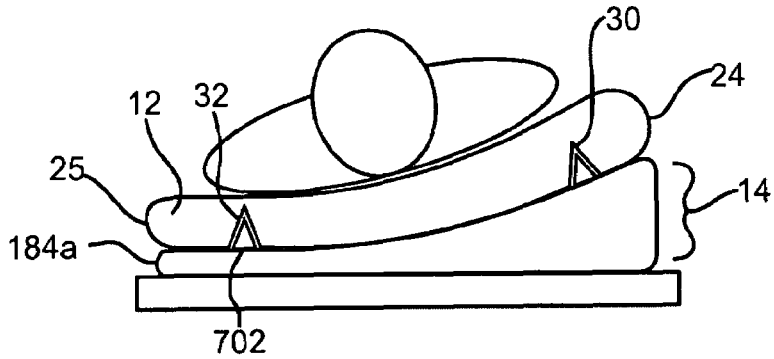
FIG. 9 is FIG. 8 rotating toward the patient's left side.

FIGS. 8-10 are similar to FIGS. 17 to 19. FIGS. 8 to 10, however, illustrate a simplified version with the cushion material 12 positioned over the rotating bladder 14, which are further positioned over support surface 400, 500, or 600.

Figure 1:
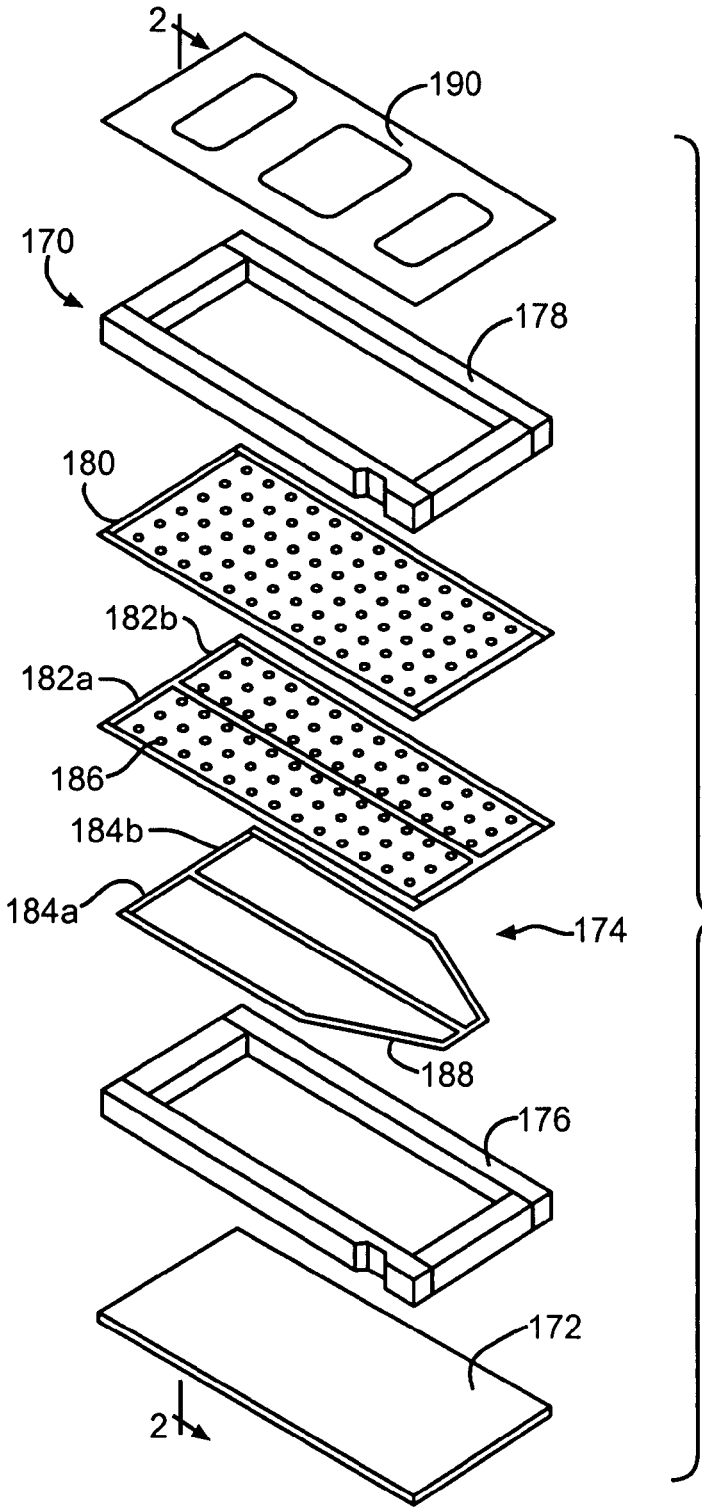
FIG. 1 (Prior Art)
FIG. 1 is an exploded view of a prior art rotating mattress.
Figure 2:
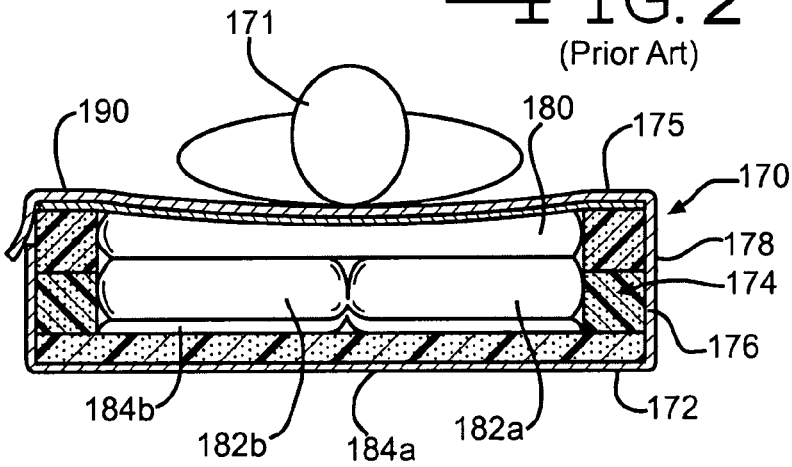
FIG. 2 (Prior Art)
FIG. 2 is a cross-sectional view of FIG. 1 taken along the lines 2-2 with a cover and a patient positioned over mattress illustrated at FIG. 1.
Figure 3:
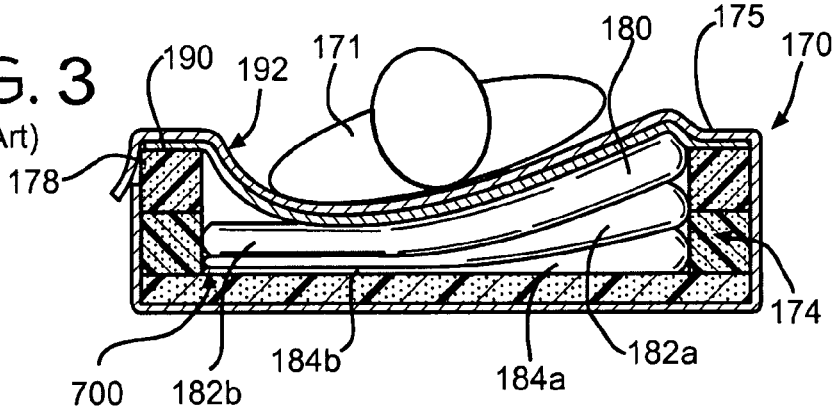
FIG. 3 (Prior Art)
FIG. 3 is FIG. 2 rotating toward the patient's left side.
Figure 4:
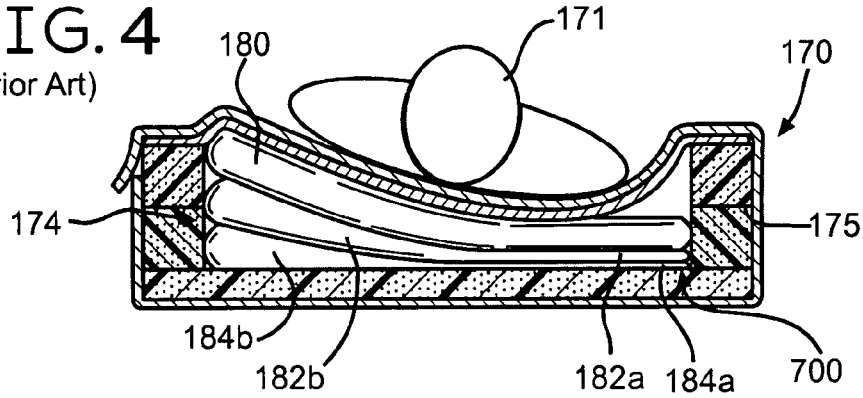
FIG. 4 (Prior Art)
FIG. 4 is FIG. 2 rotating toward the patient's right side.

Whichever rotating bladder embodiment is used, the rotating bladder 14 can be positioned over a portion of the support surface 400, 500, 600. By a portion, the rotating bladder 14 can be positioned exclusively under (a) the head/torso area 26, (b) the head/torso and seat areas 20, 27, or (c) as illustrated in FIG. 1.

Rotating Bladder Hinge Embodiment

Figure 22A:
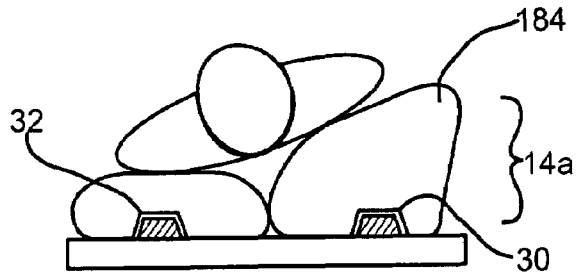
FIG. 22*a* is an alternative embodiment of FIG. 9 without the cushion material and the upper bladder of the rotating bladder 14.
Figure 22B:
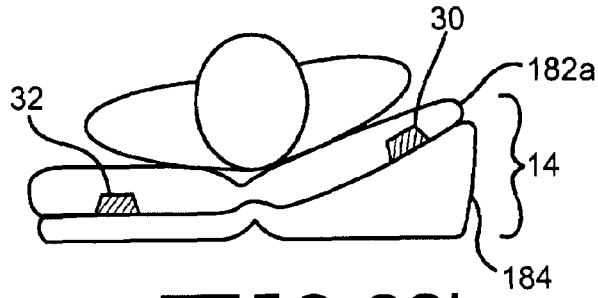
FIG. 22*b* is an alternative embodiment of FIG. 9 without the cushion material.

A simpler embodiment is illustrated at FIGS. 22*a* and 22*b*. In some embodiments, there may not be a cushion material 12 positioned between the rotating bladder 14 (FIG. 22*b*) or a rotating bladder 14*a* (rotating bladder 14 consisting only of lower bladder 184) (FIG. 22*a*), and the patient. An example of that embodiment occurs in Gaymar's XPRT pulmonary mattress system. When that embodiment is used, the rotating bladder 14*a* or 14 can have the longitudinal hinges 30, 32. The preferred longitudinal hinges 30, 32 are the same as described above (each hinge has a shaped opening 50 and within the shaped opening 50 is the second cushion material) and operate in the same manner to decrease shear forces applied to the patient and simultaneously decrease the chance a patient will fall off the mattress by moving the rotating bladder's fulcrum point to the longitudinal hinge area, and not the right/left side of the rotating bladder.

What ever hinge embodiment is used, the longitudinal hinges 30, 32 decrease the chance a patient will fall off the mattress by moving the rotating bladder's fulcrum point from the left and right side edges of the rotating bladder toward the longitudinal hinge. As you may recall, the longitudinal hinge is positioned a predetermined distance from the left and right side edges of the rotating bladder to accomplish this objective.

Obviously, the rotating bladder hinge embodiment can have the preferred first horizontal hinge 34 and the second horizontal hinge 36 as described above.

Alternative Longitudinal Hinge

The preferred embodiment of the longitudinal hinge is described above. The longitudinal hinges 30, 32 can also be for patentability purposes slits (FIG. 16*b*) and mechanical hinges (metal, rods, pivot hinges and equivalents thereof). As previously stated, the slit embodiment and, obviously, the mechanical hinge embodiments do not decrease the shear pressure like the preferred embodiment. However, since the applicants are unaware of any prior art disclosing a longitudinal hinge in a mattress system to decrease the chance of a patient rolling off the mattress, the present invention includes these other hinges, but not for decreasing the shear pressure to the patient.

Passive Restraint

Figure 23A:
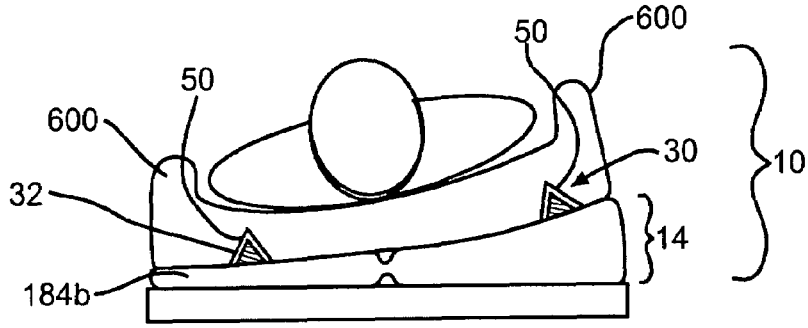
FIG. 23*a* is an alternative embodiment of FIG. 9 with passive restraints thereon.
Figure 23B:
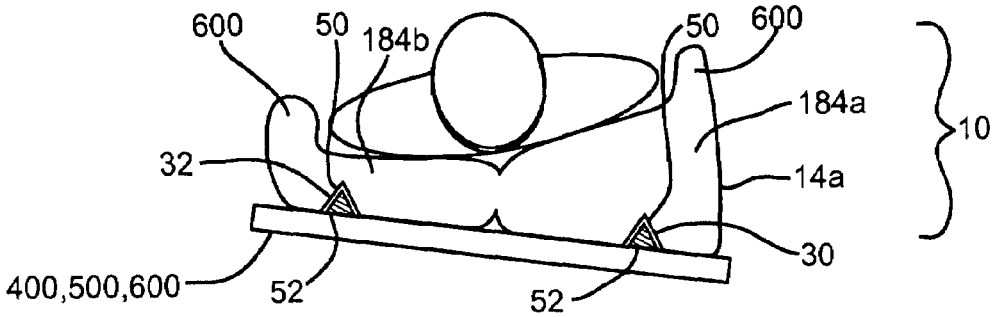
FIG. 23*b* is an alternative embodiment of FIG. 22*a* with passive restraints thereon.

To further decrease the chance of a patient falling off the mattress 10, the mattress can have a passive restraint 600. The passive restraint 600 can be positioned entirely along or partially along the mattress' 10 right and left side edges of the cushion material 12 as illustrated in FIG. 23*a* or the rotating cushion 14*a* as illustrated in FIG. 23*b*. The passive restraint 600 can be foam, gelastic material, a fluid (air or water) contained within a fluid-impervious material, or combinations thereof.

The passive material 600 can be permanently attached to the mattress 10, fluidly interconnected to the mattress 10, detachably connected to the mattress 10, or combinations thereof.

The passive material can be positioned along (a) the length of the entire mattress 10, (b) the head/torso section, (c) the seat section, (d) the lower leg section, (e) the head/torso section and the lower leg section, (f) the head/torso section and the seat section, or (g) the seat section and the lower leg section.

Overlay Cushion

Figure 24:
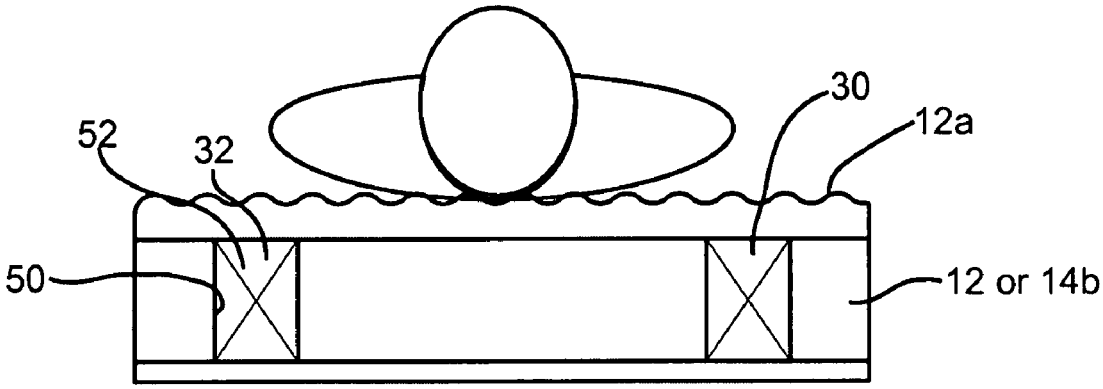
FIG. 24 is an alternative embodiment of FIG. 8 and FIG. 22*a* (when right and left bladders are equal) with an overlay cushion material is positioned thereon.

An additional cushion 12*a* can overlay the cushion 12 and/or rotatable cushion 14*b* (which is above-identified item 14 or 14*a* when the rotatable cushion has longitudinal hinges) as illustrated in FIG. 24. The additional cushion 12*a* can be (a) an inflatable bladder or a plurality of inflatable bladders (air, water, or combinations thereof) having or not having button welds uniformly spaced thereover to prevent ballooning thereof when pressurized; (b) a gelastic cushion or a plurality of gelastic cushions made of tri-block copolymeric compositions, an example is described in U.S. Pat. No. 7,060,213; (c) a foam cushion or a plurality of foam cushions, or (d) combinations thereof.

It is intended that the above description of the preferred embodiments of the structure of the present invention and the description of its operation are but one or two enabling best mode embodiments for implementing the invention. Other modifications and variations are likely to be conceived of by those skilled in the art upon a reading of the preferred embodiments and a consideration of the appended claims and drawings. These modifications and variations still fall within the breadth and scope of the disclosure of the present invention.

I claim:

1. A rotating mattress comprising:

a support surface;

a rotating bladder positioned above at least a portion of the support surface, having a right bladder and a left bladder, the right bladder is interconnected to a first pump that provides a fluid to the right bladder, and the left bladder is interconnected to a second pump that provides fluid to the left bladder;

a cushion material (a) positioned over the rotating bladder and the support surface, (b) has a head end, a foot end, a right side, a left side, a top surface and a bottom surface, (c) has a first longitudinal hinge (i) extending from the head end toward the foot end, and (ii) is parallel to and near the right side, (d) a second longitudinal hinge (i) extending from the head end toward the foot end, (ii) is parallel to and near the left side, and (iii) that is not the first longitudinal hinge;

wherein when the cushion material is rotated by having the right rotatable bladder raise the right side above the left side, the cushion material's fulcrum point is at the second longitudinal hinge and wherein when the cushion material is rotated by having the left rotatable bladder raise the left side above the right side, the cushion material's fulcrum point is at the first longitudinal hinge.

2. The rotating mattress of claim 1 wherein the first longitudinal hinge has a first shaped aperture having a second cushion material positioned in the first shaped aperture; and the second longitudinal hinge has a second shaped aperture having the second cushion material positioned in the second shaped aperture.

3. The rotating mattress of claim 1 wherein the second cushion material is less rigid than the cushion material.

4. The rotating mattress of claim 1 wherein the support surface is a gatching support surface having a torso/head area, a seat area and a leg area.

5. The rotating mattress of claim 4 wherein the rotating mattress has a first horizontal hinge (a) positioned over the juncture between the torso/head area and the seat area, (b) extends from the left side to the right side, and (c) is a third shaped aperture having the second cushion material positioned in the third shaped aperture.

6. The rotating mattress of claim 4 wherein the rotating mattress has a second horizontal hinge (a) positioned over the juncture between the seat area and the leg area, (b) extends from the left side to the right side, and (c) is a fourth shaped aperture having the second cushion material positioned in the fourth shaped aperture.

7. The rotating mattress of claim 1 wherein the cushion material is selected from the group consisting of inflatable bladders, gelastic cushions made of tri-block copolymeric compositions, foam cushions, or combinations thereof.

8. The rotating mattress of claim 1 wherein the support surface has a head/torso area, a seat area and a leg area.

9. The rotating mattress of claim 8 wherein the first longitudinal hinge extends toward the foot end and terminates at a first predetermined location selected from the group consisting of the head/torso area at least 5 inches from the head end, the juncture between the head/torso area and the seat area, the seat area, the juncture between the seat area and the leg area, the leg area, and the foot end; and wherein the second longitudinal hinge extends toward the foot end and terminates at a second predetermined location selected from the group consisting of the head/torso area at least 5 inches from the head end, the juncture between the head/torso area and the seat area, the seat area, the juncture between the seat area and the leg area, the leg area, and the foot end.

10. The rotating mattress of claim 1 wherein the first pump and the second pump are the same.

11. The rotating mattress of claim 1 wherein the rotating mattress has a passive restraint attached to at least portions of the cushion material's right side and left side.

12. A rotating mattress comprising:

a support surface has a head/torso area, a seat area and a leg area;

a rotating bladder positioned above at least a portion of the support surface, having a right bladder and a left bladder, the right bladder is interconnected to a pump that provides a fluid to the right bladder, and the left bladder is interconnected to the pump that provides fluid to the left bladder;

a cushion material (a) positioned over the rotating bladder and the support surface, (b) has a head end, a foot end, a right side, a left side, a top surface and a bottom surface, (c) has a first horizontal hinge (i) positioned over the juncture between the torso/head area and the seat area, (ii) extends from the left side to the right side, and (iii) has a first horizontal shaped aperture having a second cushion material positioned in the first horizontal shaped aperture.

13. The rotating mattress of claim 12 further comprising a first longitudinal hinge (i) extending from the head end toward the foot end and (ii) is parallel to and near the right side, and a second longitudinal hinge (i) extending from the head end toward the foot end and (ii) is parallel to and near the left side;

the first longitudinal hinge is selected from a group consisting of (a) a slit, (b) a mechanical hinge, and (c) a first longitudinal shaped aperture having the second cushion material positioned in the first longitudinal shaped aperture; and the second longitudinal hinge is selected from a group consisting of (a) a slit, (b) a mechanical hinge, and (c) a second longitudinal shaped aperture having the second cushion material positioned in the second longitudinal shaped aperture;

wherein when the cushion material is rotated by having the right rotatable bladder raise the right side above the left side, the cushion material's fulcrum point is at the second longitudinal hinge and wherein when the cushion material is rotated by having the left rotatable bladder raise the left side above the right side, the cushion material's fulcrum point is at the first longitudinal hinge.

14. The rotating mattress of claim 12 wherein the second cushion material is less rigid than the cushion material.

15. The rotating mattress of claim 12 wherein the rotating mattress has a passive restraint attached to at least portions of the cushion material's right side and left side.

16. The rotating mattress of claim 12 wherein the rotating mattress has a second horizontal hinge (a) positioned over the juncture between the seat area and the leg area, (b) extends from the left side to the right side, and (c) has a second horizontal shaped aperture having the second cushion material positioned in the second horizontal shaped aperture.

17. The rotating mattress of claim 12 wherein the cushion material is selected from the group consisting of inflatable bladders, gelastic cushions made of tri-block copolymeric compositions, foam cushions, or combinations thereof.

18. The rotating mattress of claim 12 wherein the first longitudinal hinge extends toward the foot end and terminates at a first predetermined location selected from the group consisting of the head/torso area at least 5 inches from the head end, the juncture between the head/torso area and the seat area, the seat area, the juncture between the seat area and the leg area, the leg area, and the foot end; and wherein the second longitudinal hinge extends toward the foot end and terminates at a second predetermined location selected from the group consisting of the head/torso area at least 5 inches from the head end, the juncture between the head/torso area and the seat area, the seat area, the juncture between the seat area and the leg area, the leg area, and the foot end.

19. A rotating mattress comprising:

a support surface;

a rotating bladder (a) positioned above at least a portion of the support surface, (b) has a head end, a foot end, a right side, a left side, a top surface and a bottom surface, (c) has a right bladder and a left bladder, the right bladder is interconnected to a first pump that provides a fluid to the right bladder, and the left bladder is interconnected to a second pump that provides fluid to the left bladder;

the right bladder has a first longitudinal hinge (i) extending from the head end toward the foot end, and (ii) is parallel to and near the right side, the left bladder has a second longitudinal hinge (i) extending from the head end toward the foot end, (ii) is parallel to and near the left side, and (iii) is not the first longitudinal hinge;

wherein when the rotating mattress is rotated by having the right rotatable bladder raise the right side above the left side, the rotating mattress' fulcrum point is at the second longitudinal hinge and wherein when the rotating mattress is rotated by having the left rotatable bladder raise the left side above the right side, the rotating mattress' fulcrum point is at the first longitudinal hinge.

20. The rotating mattress of claim 19 further comprising a passive restraint attached to at least portions of the rotating bladder's right side and left side.

* * * * *